US006736152B2

(12) United States Patent
Zheng

(10) Patent No.: US 6,736,152 B2
(45) **Date of Patent: *May 18, 2004**

(54) COLLAPSIBLE PANELS HAVING MULTIPLE FRAME MEMBERS

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/307,831

(22) Filed: Dec. 2, 2002

(65) Prior Publication Data

US 2003/0079769 A1 May 1, 2003

Related U.S. Application Data

(63) Continuation of application No. 09/579,600, filed on May 26, 2000, now Pat. No. 6,491,052.

(51) Int. Cl.[7] ..... E04H 15/40
(52) U.S. Cl. ..... 135/126
(58) Field of Search ..... 135/115, 124, 135/125, 126, 128; 160/370.21, DIG. 2; 296/97.7, 97.8

(56) References Cited

U.S. PATENT DOCUMENTS 4,815,784 A 3/1989 Zheng
4,825,892 A 5/1989 Norman
4,858,634 A 8/1989 McLeese
5,137,044 A 8/1992 Brady
5,163,461 A 11/1992 Ivanovich et al.
5,249,592 A * 10/1993 Springer et al. ..... 135/126
5,385,165 A 1/1995 Hazinski et al.
5,439,017 A 8/1995 Brown
5,452,934 A 9/1995 Zheng
5,560,385 A 10/1996 Zheng
5,601,105 A 2/1997 Blen et al.
5,676,168 A 10/1997 Price
5,778,915 A 7/1998 Zheng
5,800,067 A 9/1998 Easter
5,941,265 A 8/1999 Zheng
6,032,685 A 3/2000 Zheng
6,082,386 A * 7/2000 Zheng ..... 135/126
6,098,349 A * 8/2000 Zheng ..... 52/126.1
6,491,052 B1 * 12/2002 Zheng ..... 135/125

* cited by examiner

*Primary Examiner*—Janet M. Wilkens
(74) *Attorney, Agent, or Firm*—Raymond Sun

(57) ABSTRACT

Collapsible panels are provided which incorporate two or more separate frame members. The frame members can be positioned at separate locations on the panel, or two or more frame members can be housed in the same frame retaining sleeve. One or more of the panels can be used to form collapsible structures. These collapsible structures can be easily and quickly folded and collapsed into a compact configuration.

3 Claims, 14 Drawing Sheets

COLLAPSIBLE PANELS HAVING MULTIPLE FRAME MEMBERS

1. RELATED CASES

This is a continuation of Ser. No. 09/579,600, entitled "Collapsible Panels Having Multiple Frame Memvber", filed May 26, 2000, now U.S. Pat. No. 6,491,053 whose disclosure is incorporated by this reference as though fully set forth herein.

BACKGROUND OF THE INVENTION

1. Field of the Invention

The present invention relates to collapsible structures, and in particular, to structures having panels that incorporate two or more frame members.

2. Description of the Prior Art

There are presently many collapsible structures that are being provided for use by children and adults. Examples of these collapsible structures are illustrated in the following patents: U.S. Pat. No. 5,560,385 (Zheng), U.S. Pat. No. 5,778,915 (Zheng), U.S. Pat. No. 4,815,784 (Zheng), U.S. Pat. No. 5,452,934 (Zheng), U.S. Pat. No. 5,941,265 (Zheng), U.S. Pat. No. 4,858,634 (McLeese) and U.S. Pat. No. 4,825,592 (Norman), among others. These collapsible structures are supported by one or more frame members that can be twisted and folded to reduce the overall size of the structure. Each frame member typically supports and defines one or more collapsible panels. These collapsible structures can be used in a wide variety of applications, such as containers, tents, play structures, executive toys, shelters, sports structures, and others. As a result, collapsible structures have become very popular.

Even though these collapsible structures exhibit surprising versatility in their utility and wide-ranging applications, the consumer is always demanding greater enhancements, better and more features, added convenience, and other related factors. Related to the pursuit of added enhancements and features, one potential drawback associated with these structures is that only one frame member is used to support each collapsible panel. A single frame member can adequately support a smaller panel, but if a larger panel is needed for the desired application, the use of a single frame member may not provide sufficient structural support for the panel, so that the stability of the resulting structure may be structurally weak. For example, large tents, game and sport centers, and other related structures often require large panels to define the resulting structures. Thus, the use of a single frame member to support a panel limits the sizes and shapes in which the resulting structure can be provided.

The use of a single frame member to support a panel also imposes other limitations on the resulting panel or structure. For example, the frame member for most of these collapsible structures typically defines the periphery of its associated panel, so that the periphery of these panels would be relatively rigid and stable. However, the other portions (e.g., portions covered by the fabric associated with the frame member to form the panel) would have less support, which would make it more difficult to attach other panels and objects to such portions.

Thus, there remains a need to provide collapsible panels that overcome the drawbacks mentioned above, and which can be used for a wide variety of structures and applications.

SUMMARY OF THE DISCLOSURE

It is an object of the present invention to provide collapsible panels that can be used in a wide variety of applications.

It is another object of the present invention to provide collapsible panels that have varying support at different portions of these panels.

It is yet another object of the present invention to provide collapsible panels that have a plurality of frame members.

The present invention provides collapsible panels that incorporate two or more separate frame members. The frame members can be positioned at separate locations on the panel, or two or more frame members can be housed in the same frame retaining sleeve. One or more of the panels can be used to form collapsible structures. These collapsible structures can be easily and quickly folded and collapsed into a compact configuration.

Thus, the present invention provides panels having one or more frame members that are configured and positioned at a variety of different locations to provide panels having better stability and rigidity at selected locations. As a result, stronger and more useful panels can be provided for use in a wider range of applications, thereby increasing the utility, value, and entertainment of collapsible panels, and the resulting collapsible structures which are assembled from these panels.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible panels that incorporate two or more separate frame members to accomplish one or both of the following objectives: (1) to provide the entire panel with additional rigidity and structural stability, and (2) to provide selected locations of the panel with additional rigidity and structural stability. One or more of the panels can be used to form collapsible structures.

Figure 2:
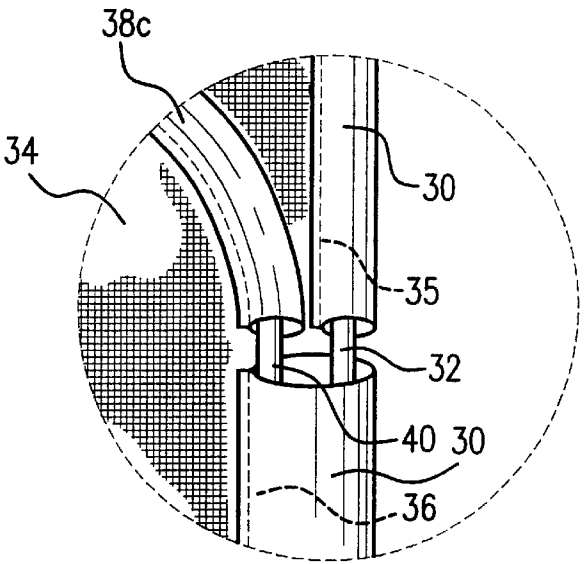
FIG. 2 is a partial cut-away view of the section A of the panel of FIG. 1.
Figure 1:
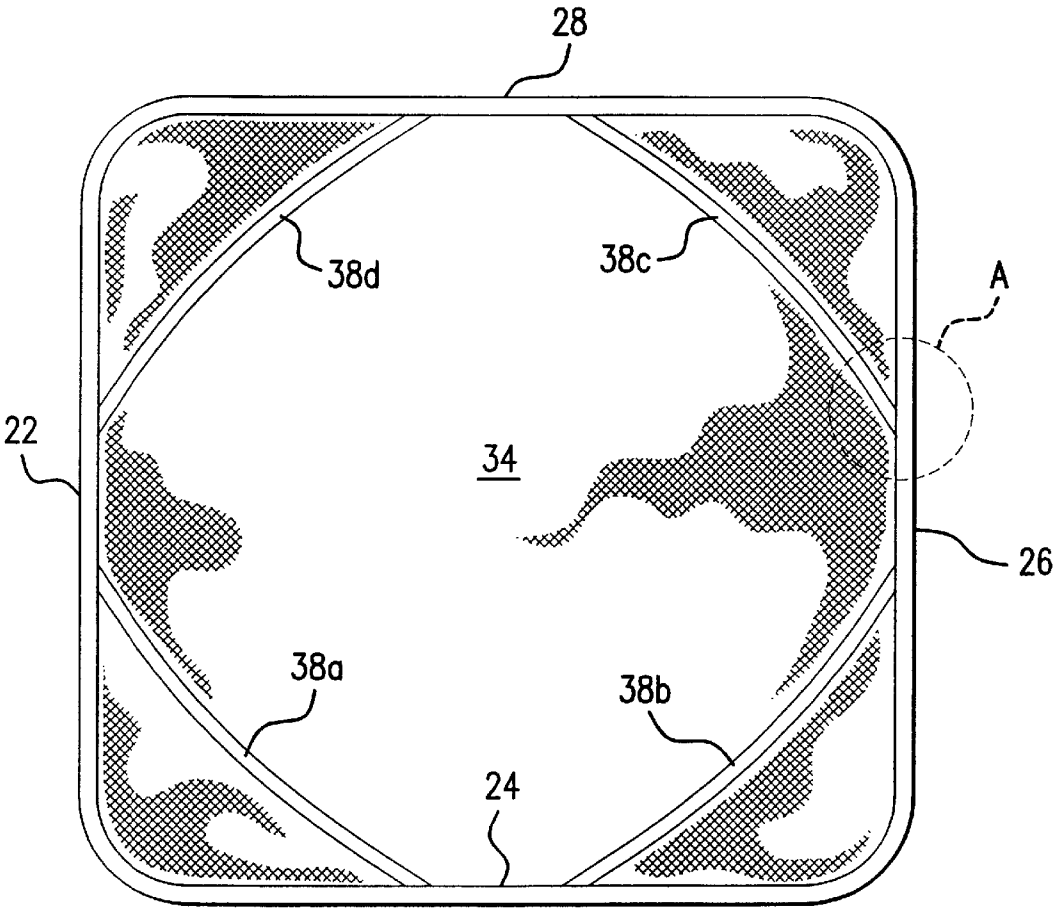
FIG. 1 is a perspective view of a collapsible panel according to one embodiment of the present invention.

FIG. 1 illustrates a collapsible panel 20 according to a first embodiment of the present invention. The panel 20 is a single panel that has four sides, a left side 22, a bottom side 24, a right side 26 and a top side 28. A first continuous frame retaining sleeve 30 ("first sleeve") is provided along and traverses the edges of its four sides 22, 24, 26, 28. As shown in FIG. 2, a first continuous frame member 32 is retained or held within the first sleeve 30 to support the panel 20.

The continuous frame member 32 may be provided as one continuous loop, or may comprise a strip of material connected at both ends to form a continuous loop. The continuous frame member 32 is preferably formed of flexible coilable steel having a memory, although other materials such as plastics may also be used. The frame member 32 should be made of a material which is relatively strong and yet is flexible to a sufficient degree to allow it to be coiled. Thus, the frame member 32 is capable of assuming two positions or orientations, an open or expanded position such as shown in FIG. 1, or a folded position in which the frame member 32 is collapsed into a size which is much smaller than its open position (see FIG. 12E).

Fabric or sheet material 34 extends across the panel 20, and is held taut by the frame member 32 when in its open position. Fabric 34 can extend completely across the panel 20 to entirely cover the enclosed space defined by the frame member 32, or can extend across selected portions of the enclosed space defined by the frame member 32. The term fabric is to be given its broadest meaning and should be made from strong, lightweight materials and may include woven fabrics, sheet fabrics or even films. The fabric should be water-resistant and durable to withstand wear and tear. The type of material used for the fabric 34 can be varied depending on the intended use. As one non-limiting example, a tough film-like material can be used if the panel 20 is intended for use as part of an item that will experience significant wear-and-tear, rough or outdoor use. As another non-limiting example, a cloth-like material can be used if the panel 20 is intended primarily for indoor use.

Referring to FIG. 2, the fabric piece 34 is stitched at its edges by a stitching 36 to the first sleeve 30. The first sleeve 30 may be formed by folding a piece of fabric, and then applying the stitching 36 to connect the first sleeve 30 to the fabric 34. Alternatively, the first sleeve 30 may be formed by merely folding over the fabric 30 and applying the stitching 36. The frame member 32 may be merely retained within the first sleeve 30 without being connected thereto. Alternatively, the first sleeve 30 may be mechanically fastened, stitched, fused, or glued to the frame member 32 to retain it in position.

A second frame retaining sleeve 38 ("second sleeve") can be provided at or along selected locations of the panel 20 to retain a second frame member 40. The second frame member 40 is provided to accomplish one or both of the following objectives: (1) to provide the entire panel 20 with additional rigidity and structural stability, and (2) to provide selected locations of the panel 20 with additional rigidity and structural stability. The second frame member 40 can be made from the same material as the first frame member 32.

As shown in FIG. 1, the second frame retaining sleeve 38 extends diagonally along the fabric 34 between adjacent sides 22, 24, 26, 28 of the panel 20, and shares the same sleeve as the first frame retaining sleeve 30 along a length of each side 22, 24, 26, 28. Specifically, the second sleeve 38 has four sections 38*a*, 38*b*, 38*c* and 38*d* that extend diagonally along the fabric between the sides 22+24, 24+26, 26+28 and 28+22, respectively. Between the sections 38*a* and 38*b*, the second frame member 40 extends along a portion of the first sleeve 30 at side 24 together with the first frame member 32. Similarly, between the sections 38*b* and 38*c*, the second frame member 40 extends along a portion of the first sleeve 30 at side 26 together with the first frame member 32. Then, between the sections 38*c* and 38*d*, the second frame member 40 extends along a portion of the first sleeve 30 at side 28 together with the first frame member 32. Finally, between the sections 38*d* and 38*a*, the second frame member 40 extends along a portion of the first sleeve 30 at side 22 together with the first frame member 32. Each sleeve section 38*a*, 38*b*, 38*c* and 38*d* can be formed by stitching each tubular sleeve section 38*a*, 38*b*, 38*c* and 38*d* to the fabric 34 at the desired locations.

Thus, as shown in FIG. 1, the second frame member 40 provides increased rigidity and support for the entire panel 20 since there are now two frame members 32, 40 that support portions of all four sides 22, 24, 26, 28 of the panel 20. In addition, by extending along the diagonal sections 38*a*, 38*b*, 38*c* and 38*d*, the second frame member 40 also provides increased rigidity and support to the corners of the panel 20, thereby preventing the corners of the panel 20 from being coiled or bent unless a significant force is applied.

Figure 3:
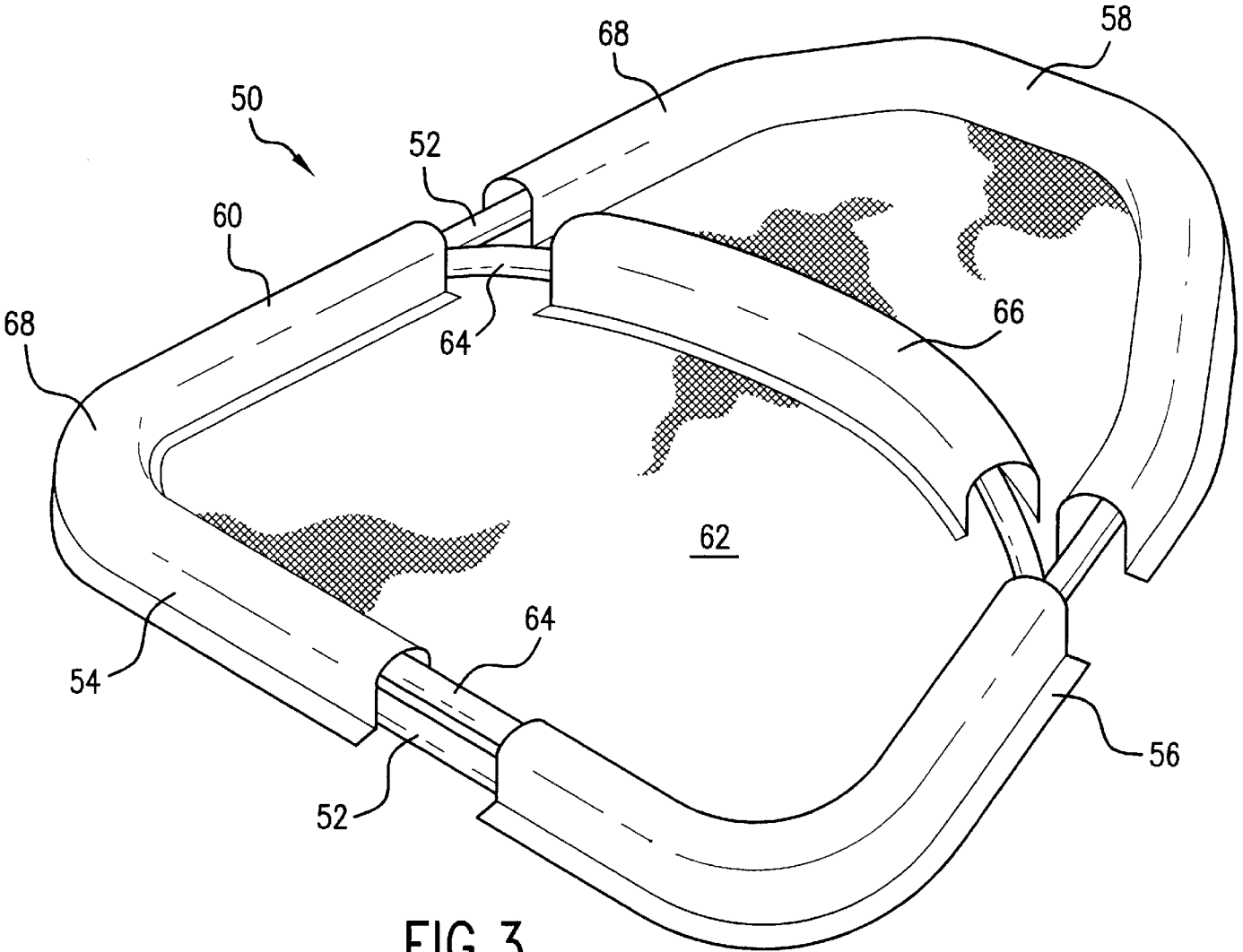
FIGS. 3–7 are perspective views of collapsible panels according to other embodiments of the present invention.

FIG. 3 illustrates another panel 50 that is similar to panel 20, in that the panel 50 has a first frame member 52 that extends along its periphery and four sides 54, 56, 58, 60, and has fabric 62 extending across portions of the first frame member 52. Here, the second frame member 64 does not extend along portions of all four sides 54, 56, 58, 60. Instead, the second sleeve 66 extends across the fabric 62 between the left and right sides 60 and 56, respectively. As a result, the second frame member 64 is retained inside the first sleeve 68 along the entire bottom side 54 and along the lower half portion of the left and right sides 60 and 56, respectively, and then extends along the second sleeve 66 about the mid-portion of the panel 50. The second frame member 64 is smaller than the first frame member 52. Thus, provision of the second frame member 64 at the lower portions of the panel 50 in FIG. 3 increases the rigidity and support at the lower portions of the panel 50. As a result, this panel 50 would be effective when used as a side panel or wall for large shelters or tents.

Figure 4:
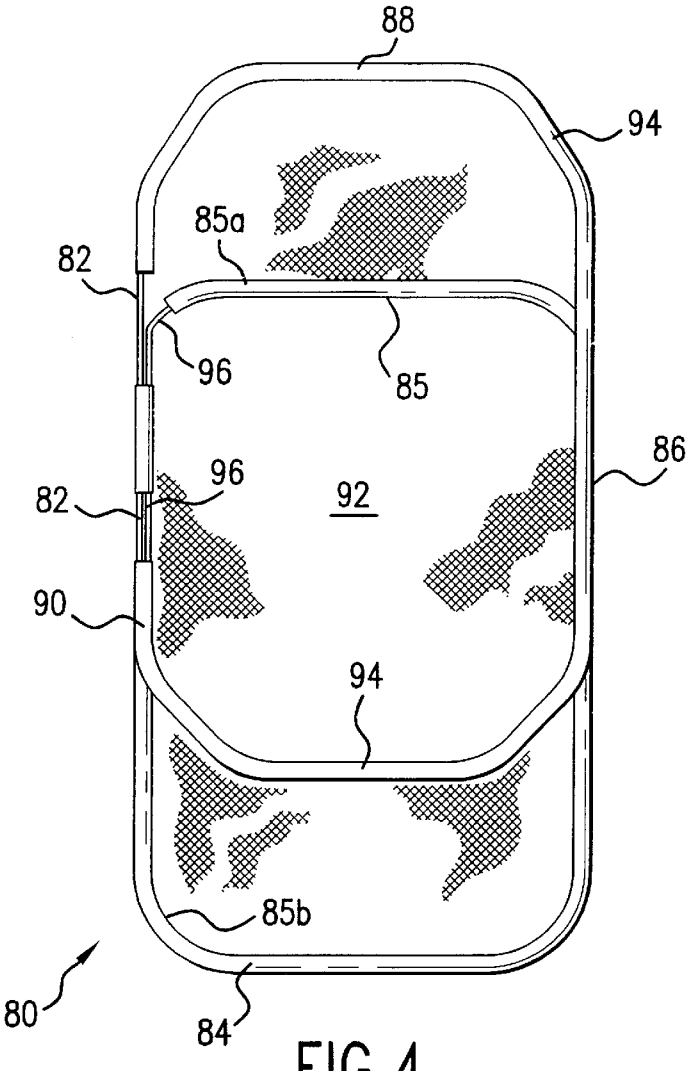

FIG. 4 illustrates yet another panel 80 that is similar to panels 20 and 50, in that the panel 80 has a first frame member 82 that extends along a portion of its periphery and three sides (i.e., 86, 88 and 90) of the four sides 84, 86, 88, 90, and has fabric 92 extending across portions of the first frame member 82. Here, the second frame member 96 extends along portions of three sides 84, 86 and 90, and the second sleeve 85 has two sections 85*a* and 85*b*. One section 85*a* extends across the fabric 92 between the left and right sides 90 and 86, respectively, and the other section 85*b* extends in a U-shaped configuration from the bottom of the first sleeve 94. As a result, the second frame member 96 is only retained inside the first sleeve 94 along portions of the left and right sides 90 and 86, respectively. The second frame member 96 then extends along the section 85*a* about the upper mid-portion of the panel 80, and extends vertically from the bottom of the first sleeve 94 along the left side 90 to the bottom side 84 and then up along the right side 86 to join the bottom of the first sleeve 94 at the right side 86. In other words, the two frame members 82 and 96, and their respective sleeves 94 and 85, overlap each other along central portions of the left and right sides 90 and 86, respectively, of the panel 80, but with the first frame member 82 defining the top side 88, and the second frame member 96 defining the bottom side 84. In one embodiment, the second frame member 96 and the first frame member 82 can have the same size.

Thus, the overlapping configuration of the two frame members 82 and 96 at the central portion of the panel 80 increases the rigidity and support at the central portion of the panel 80. As a result, this panel 80 would be effective when used to support other objects and panels at the central portion. In fact, this panel 80 can be used effectively as a large side panel or wall for large shelters or tents, because the reinforced central portion of the panel 80 allows the panel 80 to assume a larger configuration without having the central portion sag or bow.

Figure 5:
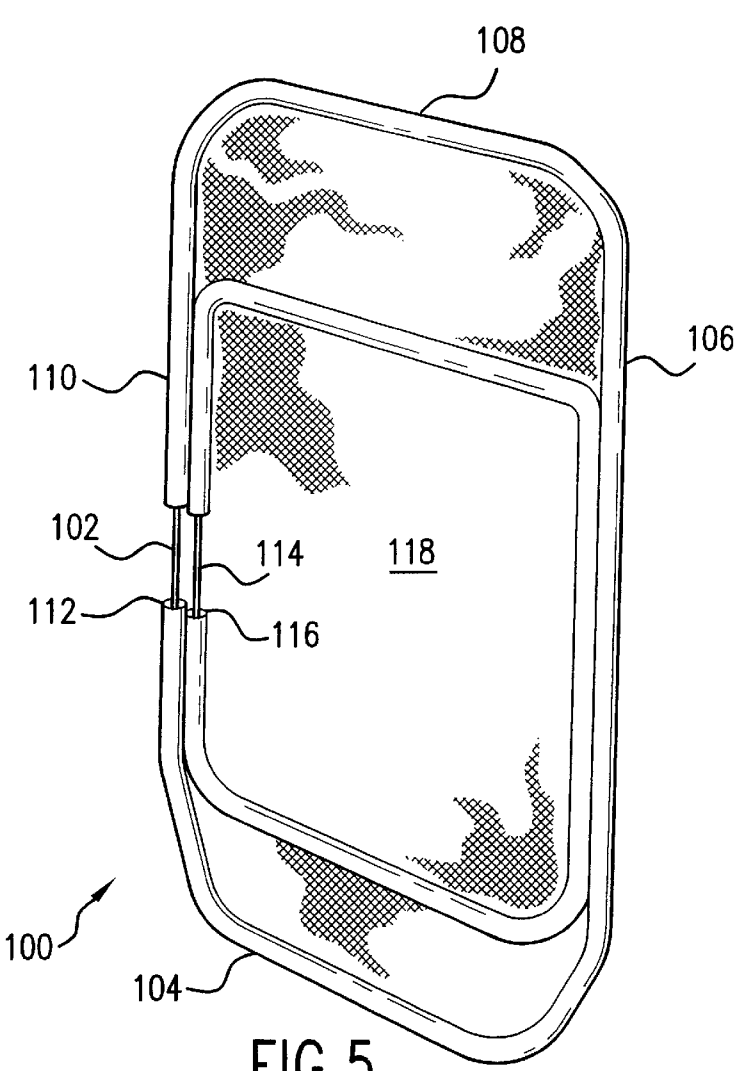

FIG. 5 illustrates another panel 100 that is similar to panel 80, in that two frame members are provided to reinforce the strength and stability of the central portion of the panel 100. However, panel 100 accomplishes this objective by providing a first frame member 102 is completely retained in a first sleeve 112 that extends along its periphery and four sides 104, 106, 108, 110 of the panel 100, and a second frame member 114 that is completely retained in a separate second sleeve 116 that extends along a central portion of the panel 100 on the fabric 118. The sides of the sleeves 112, 116 can be parallel and adjacent to each other along portions of the left side 110 and the right side 106. In other words, the two sleeves 112 and 116 are separate from each other at all times, and the two frame members 102 and 114 are always provided in different sleeves. Although FIG. 5 illustrates the second sleeve 116 and the second frame member 114 as being provided at the central portion of the panel 100, it is also possible to provide the second sleeve 116 and the second frame member 114 at any part (e.g., upper or lower) of the panel 100.

Figure 6:
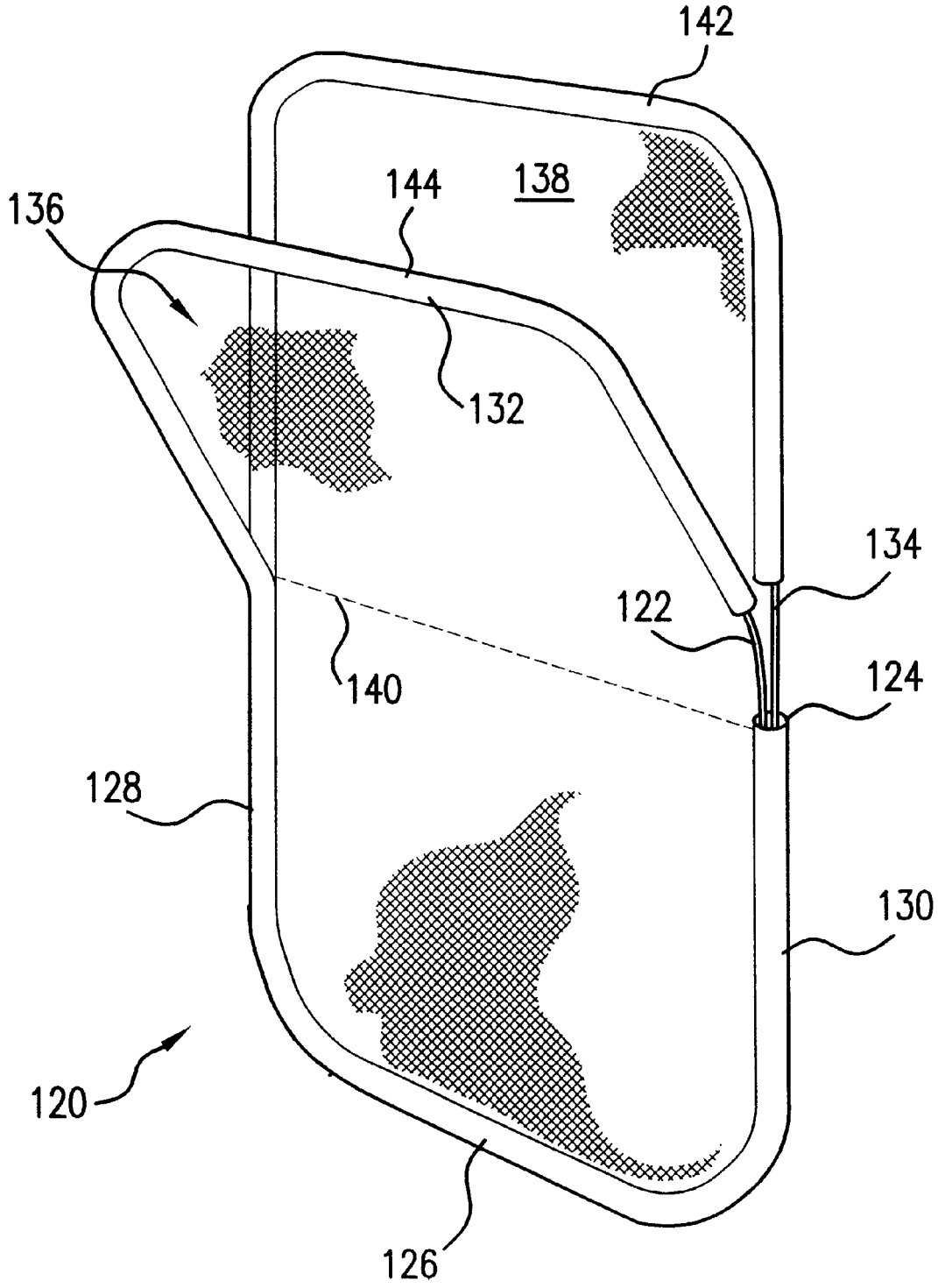

FIG. 6 illustrates another panel 120 that is similar to panel 50, in that the second frame member 122 is retained inside the first sleeve 124 along the entire bottom side 126 and along the lower half portion of the left and right sides 128 and 130, respectively, before extending along its associated second sleeve 132. However, the panel 120 is different from the panel 50 in that the second sleeve 132 and its associated second frame member 122 extends out of the plane defined by the first sleeve 124 and its associated first frame member 134, as shown in FIG. 6. A separate fabric material 136 covers portions of the second frame member 122 and the second sleeve 132 that extend out of the plane of the first frame member 134, and this fabric material 136 is separate from the fabric material 138 that covers the first frame member 134. The fabric material 136 can be attached to the fabric material 138 along a stitch line 140.

Thus, both frame members 122 and 134 can be of the same size and shape. The first frame member 134 is retained completely inside the first sleeve 124 and extends around the periphery of all four sides 126, 128, 130 and 142 of the panel 120. The second frame member 122 is retained inside the first sleeve 124 and extends around the bottom side 126 and lower portions of the left and right sides 128 and 130, respectively, before extending through the second sleeve 132 outside the plane of the first frame member 134. In other words, the second sleeve 132 and its fabric 136 defines a portion of another panel that extends out of the panel 120 at an angle therefrom, and has a top side 144. Thus, the panel 120 has two top (or bottom) sides 142 and 144 that can be used for many purposes. For example, the panel 120 can be inverted from the orientation shown in FIG. 6, and the two sides 142 and 144 can be rested on a surface (like two legs) to provide the lower portion of the panel 120 with increased stability.

Figure 7:
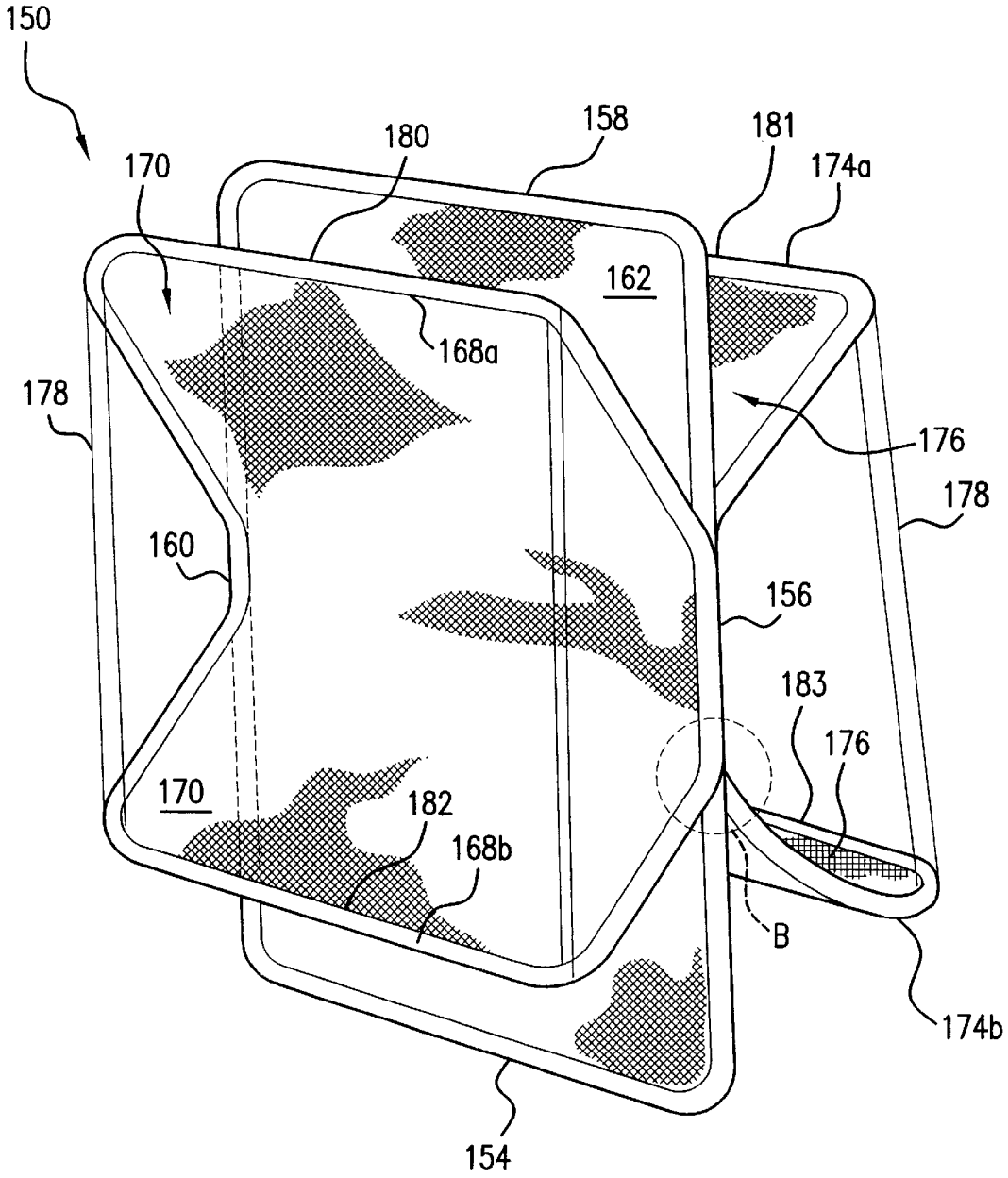
Figure 8:
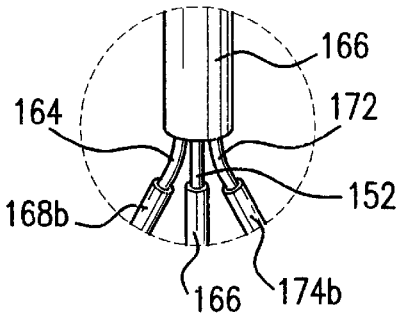
FIG. 8 is a partial cut-away view of the section B of the structure of FIG. 7.

FIG. 7 extends the principles illustrated in FIG. 6 to create other modifications. The structure 150 in FIG. 7 has a first frame member 152 retained in a first sleeve 166 that extends along its periphery and four sides 154, 156, 158, 160, and has fabric 162 extending across portions of the first frame member 152.

A second frame member 164 is retained in the first sleeve 166 along central portions of the left and right sides 160 and 156, respectively, and then extends in opposite directions (on one side of the fabric 162) into two different sections 168*a* and 168*b* of a second sleeve. The two sections 168*a* and 168*b* extend out of the plane defined by the first sleeve 166 and its associated first frame member 152 in the same manner as the sleeve 132 and its associated frame member 122 in FIG. 6. As with panel 120 in FIG. 6, a separate fabric material 170 covers portions of the second frame member 164 and the second sleeve 168*a*, 168*b* that extend out of the plane of the first frame member 152, and this fabric material 170 is separate from the fabric material 162 that covers the first frame member 152.

Similarly, a third frame member 172 is retained in the first sleeve 166 along central portions of the left and right sides 160 and 156, respectively, and then extends in opposite directions (on the other side of the fabric 162) into two different sections 174*a* and 174*b* of a third sleeve. The two sections 174*a* and 174*b* extend out of the plane defined by the first sleeve 166 and its associated first frame member 152 in the same manner as the sleeve 132 and its associated frame member 122 in FIG. 6. As with panel 120 in FIG. 6, a separate fabric material 176 covers portions of the third frame member 172 and the third sleeve 174*a*, 174*b* that extend out of the plane of the first frame member 152, and this fabric material 176 is separate from the fabric materials 162 and 170 that cover the first and second frame members 152 and 164.

To retain the second and third frame members 164 and 172 in their angled orientation with respect to the first frame member 152, a restraining member 178, such as a strap or fabric or other piece of material, can be connected (e.g., by stitching) to the top sides 180 and 181, and the bottom side 182 and 183, of each frame member 164 and 172, respectively. The restraining member 178 bends or coils each frame member 164 and 172 out of the plane defined by the first frame member 152, and retains each frame member 164 and 172 at the desired angle with respect to the first frame member 152. If the restraining member 178 is a piece of material that extends along the entire top sides 180, 181 and bottom sides 182, 183, then the structure 150 can operate as a display structure or system, with the piece of material acting as a display board for displaying artwork or other objects.

Figure 9:
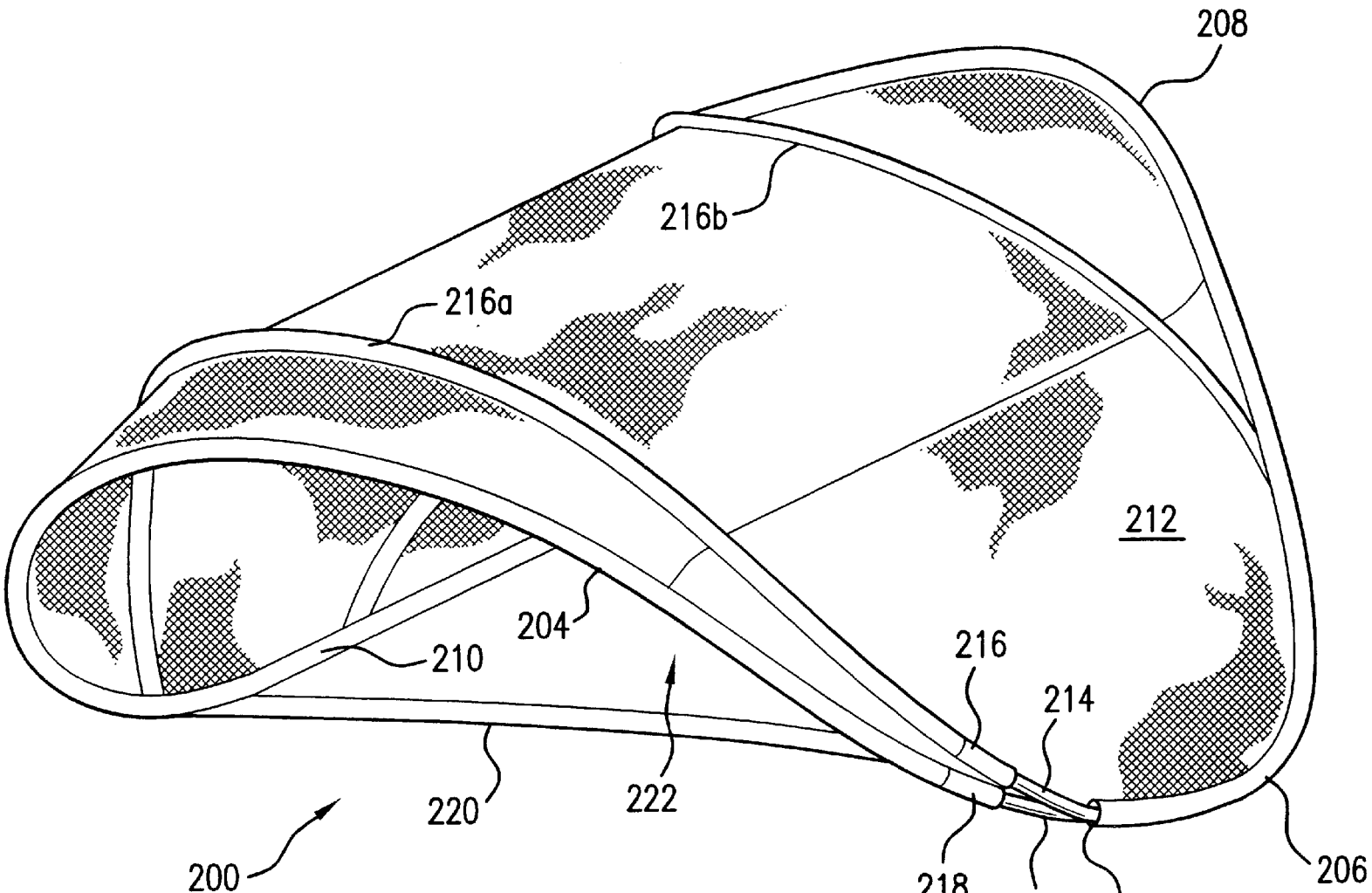
FIGS. 9 and 10 are perspective views of collapsible panels according to other embodiments of the present invention.

FIG. 9 illustrates another panel 200 that is similar to panel 20, in that the panel 200 has a first frame member 202 that extends along its periphery and four sides 204, 206, 208, 210, and has fabric 212 extending across portions of the first frame member 202. Here, the second frame member 214 does not extend along portions of all four sides 204, 206, 208, 210. Instead, the second sleeve 216 has a first section 216*a* that extends along the fabric 212 adjacent and offset from the front side 204 from one end side 206 to the opposite end side 210, and a second section 216*b* that extends along the fabric 212 adjacent and offset from the rear side 208 from the end side 206 to the opposite end side 210. As a result, the second frame member 214 is retained inside the first sleeve 218 along most of the two end sides 206 and 210 together with the first frame member 202, and then extends along the second sleeve sections 216*a* and 216*b* between the two end sides 206 and 210. The second frame member 214 can be smaller than the first frame member 202. The panel 200 can be formed into a shelter or shade structure by connecting a restraining member 220 (e.g., strap, piece of fabric or material, etc.) to the two end sides 206, 210 to coil or bend the panel 200 to define an interior space 222, with the restraining member 220 having a shorter length than the sides 204 and 208 of the panel 200. Thus, the provision of the second frame member 214 adjacent the front and rear sides 204 and 208, respectively, increases the rigidity and support adjacent these sides 204 and 208. This is important since the length of these sides 204 and 208 are very long, and require some support for the panel 200 to be able to span and define the interior of a large shelter.

Figure 10:
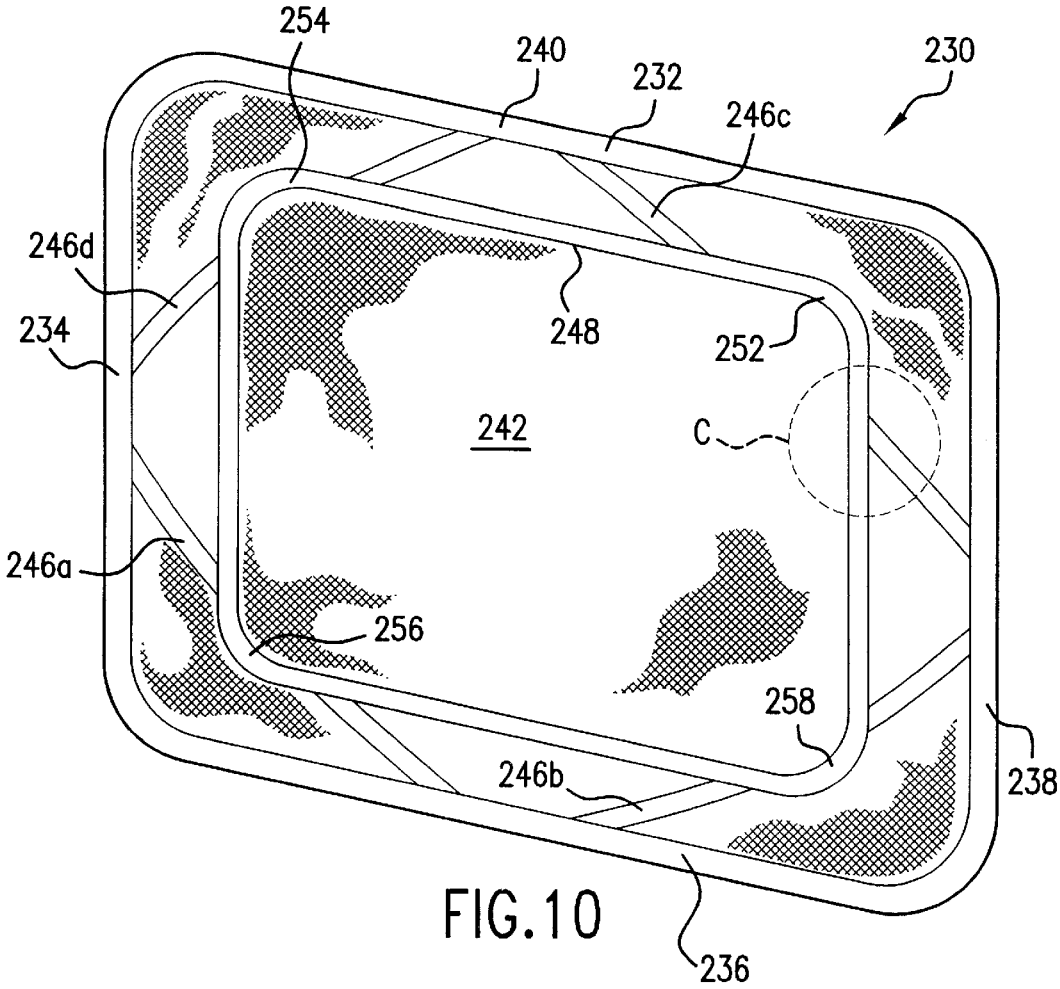
Figure 11:
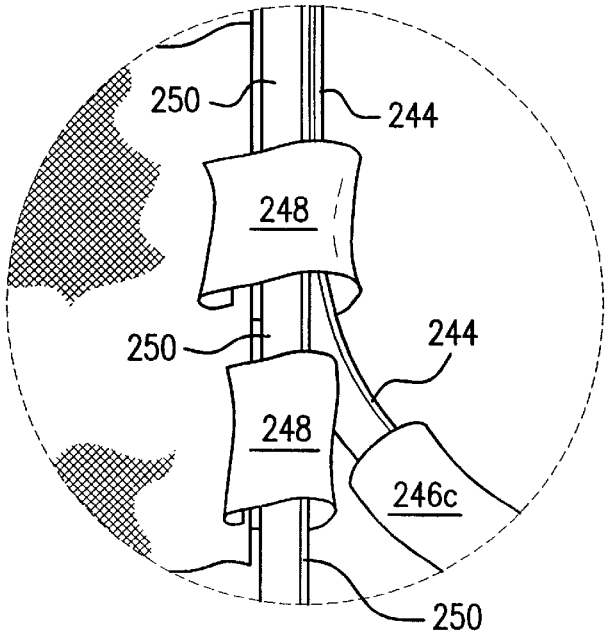
FIG. 11 is a partial cut-away view of the section C of the panel of FIG. 10.

FIGS. 10 and 11 illustrate yet another panel 230 that is similar to panel 20, in that the panel 230 has a first frame member (not shown) retained in a first sleeve 232 that extends along its periphery and four sides 234, 236, 238, 240, with fabric 242 extending across portions of the first frame member 202, and a second frame member 244 that extends along portions of all four sides 234, 236, 238, 240 in the same manner as the second frame member 40 in FIG. 1. The difference is that the sections 246*a*, 246*b*, 246*c*, 246*d* of the second sleeve are broken up by a continuous third sleeve 248 that is provided (e.g., by stitching) in the fabric 242 at about the center of the panel 230. The third sleeve 248 has a generally four-sided configuration that is about the same as the configuration of the first sleeve 232, except that the third sleeve 248 is smaller in size. A third frame member 250 is completely retained inside the third sleeve 248. As shown in FIGS. 10 and 11, the third sleeve 248 traverses the diagonal paths of each section 246*a*, 246*b*, 246*c*, 246*d* and divides each section 246*a*, 246*b*, 246*c*, 246*d* into two pieces, and as a result, the second frame member 244 also passes through portions of the third sleeve 248. In other words, the four corner portions 252, 254, 256, 258 of the third sleeve 248 would house both the second and third frame members 244 and 250. The second frame member 244 would then extend, for example, through the first sleeve 232 along the left side 234 to a first piece of the section 246*a*, through a corner 256 of the third sleeve 248, back to a second piece of the section 246*a*, then through the first sleeve 232 along the bottom side 236 to a first piece of the section 246*b*, through another corner 258 of the third sleeve 248, back to a second piece of the section 246*b*, then through the first sleeve 232 along the right side 238, and so on around the panel 230.

Thus, the panel 230 in FIGS. 10 and 11 is provided with three frame members, which significantly increase the rigidity and support of the entire panel 230 at all locations thereof. The location of the second frame member 244 supports the corners of the panel 230, and the location of the third frame member 250 supports the center of the panel 230.

Figure 12A:
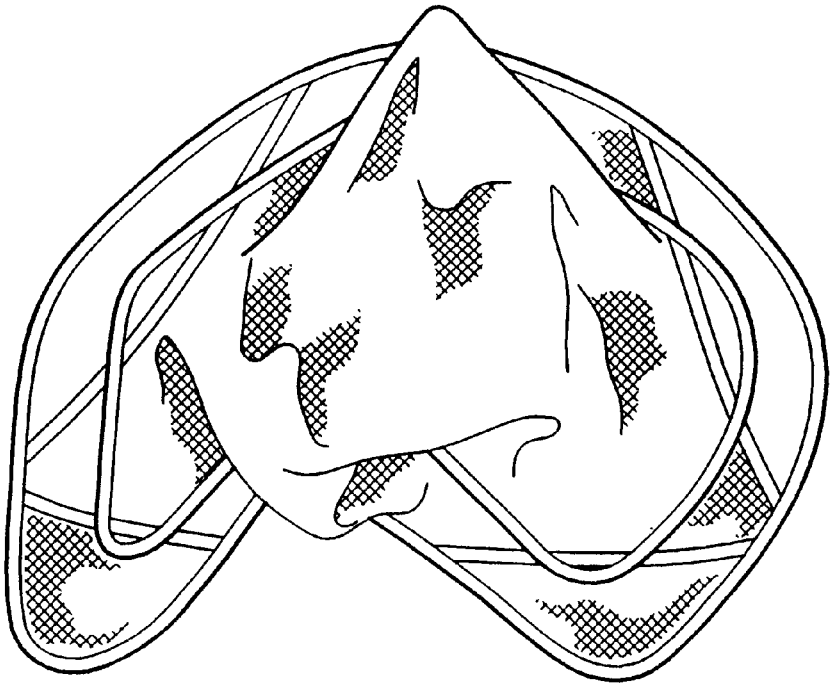
FIGS. 12A through 12E illustrate how the panel of FIG. 10 may be twisted and folded for compact storage.
Figure 12B:
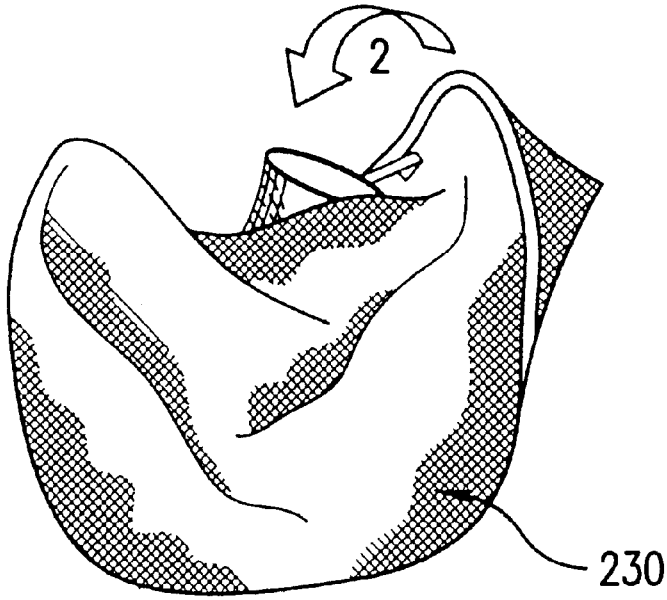
Figure 12C:
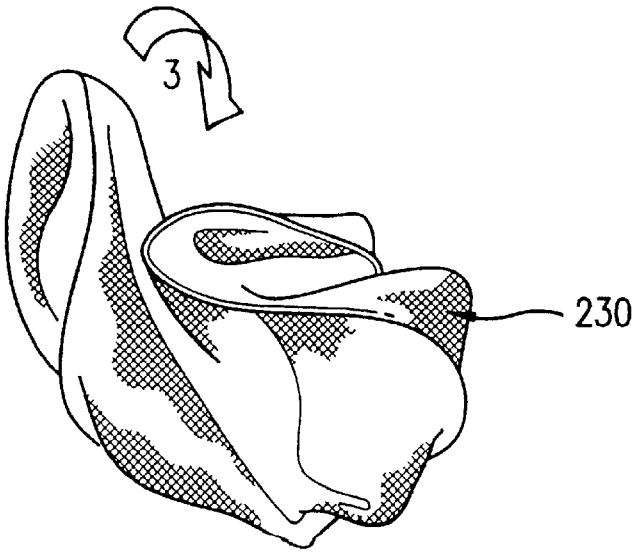
Figure 12D:
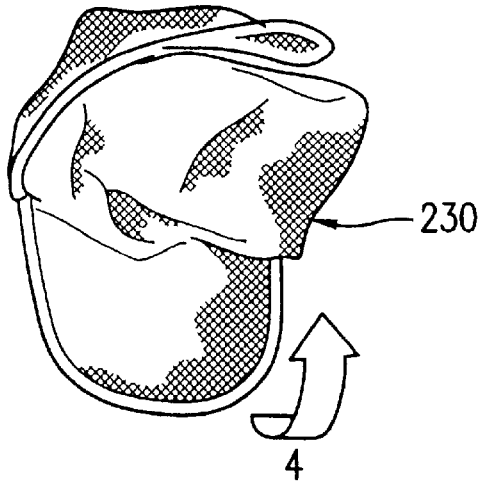
Figure 12E:
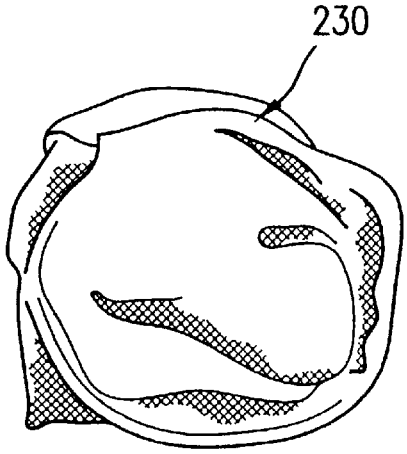

FIGS. 12A through 12E describe the various steps for folding and collapsing the panel 230 of FIG. 10 for storage. In FIG. 12A, one opposing side or border of the panel 230 is folded in to collapse the frame members with the panel 230. The three frame members will collapse (i.e., fold) at the same time. As shown in FIGS. 12B–12D, the panel 230 is twisted and folded to continue the collapsing so that the initial size of the panel 230 is reduced. FIG. 12E shows the frame members and panel 230 collapsed on each other to provide for a small essentially compact configuration having a plurality of concentric frame members and the panel 230 so that the collapsed panel 230 has a size which is a fraction of the size of the initial panel 230.

To re-open the panel 230 to its expanded configuration, the panel 230 is unfolded. The memory (i.e., spring-load) of the frame members will cause the frame members to uncoil on their own and to quickly expand the panel 230 to its expanded configuration shown in FIG. 1. The same principles can be applied to collapse, and to re-open, all the other embodiments of the present invention described herein.

Figure 13:
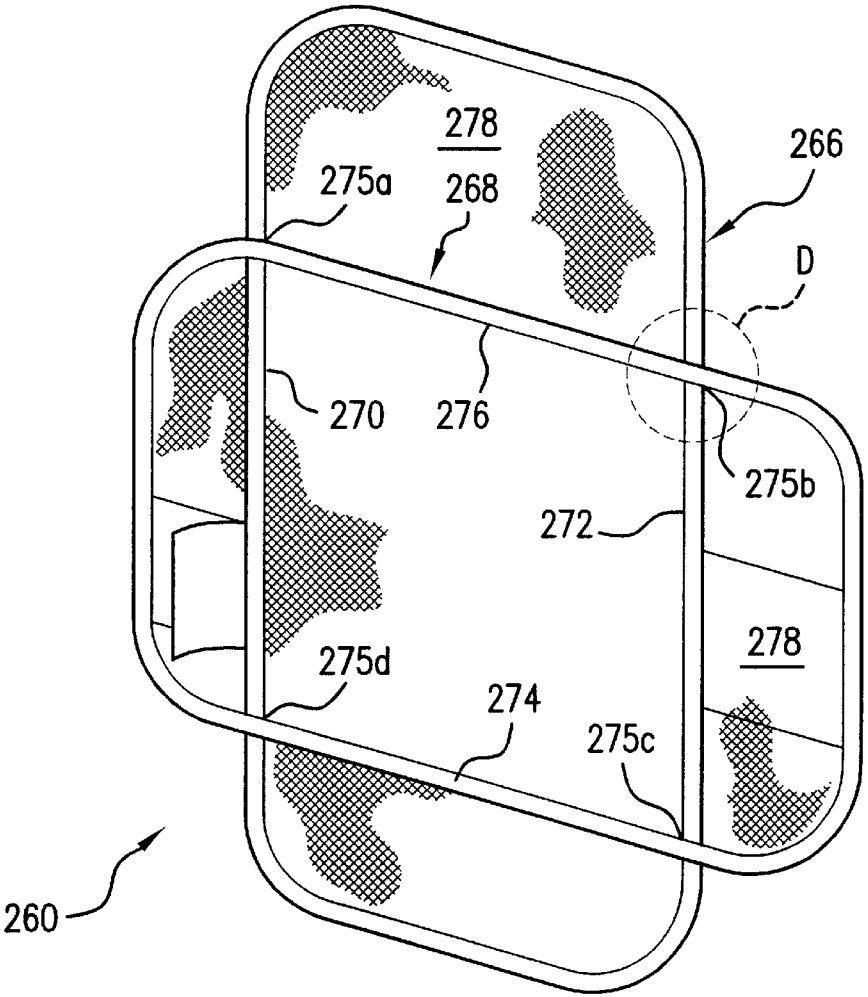
FIG. 13 is a perspective view of a collapsible panel according to another embodiment of the present invention.
Figure 14:
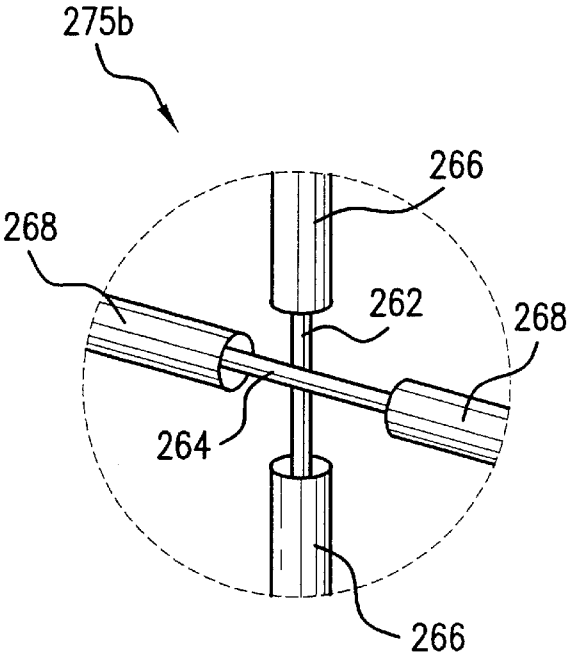
FIG. 14 is a partial cut-away view of the section D of the panel of FIG. 13.

The principles of the present invention can be applied to create panels that have different shapes and sizes. For example, FIG. 13 illustrates a panel 260 having two frame members 262 and 264 that are each configured to be four-sided in nature, and which cross each other in the same plane to form a cross-shaped panel. Each frame member 262 and 264 is retained in its own separate sleeve 266 and 268, respectively. The sleeves 266 and 268 intersect at four locations 275*a*, 275*b*, 275*c*, 275*d* along the sides 270 and 272 of the frame member 262, and sides 274 and 276 of the frame member 264. At these four locations 275*a*, 275*b*, 275*c*, 275*d*, the frame members 262 and 264 overlap or cross each other. FIG. 14 illustrates the intersection 275*b*. Fabric material 278 can be stitched to the sleeves 266 and 268 inside the regions defined by the peripheries of the sleeves 266 and 268. Thus, the panel 260 illustrates how a plurality of frame members 262, 264 can be configured together to form panels that have different shapes and sizes. In addition, the panel 260 can be provided in a large size since the crossing nature of the frame members 262, 264 provides a central portion (i.e., between the sides 270, 272, 274, 276 and the intersection points 275*a*, 275*b*, 275*c*, 275*d*) that has increased rigidity and stability.

Figure 15:
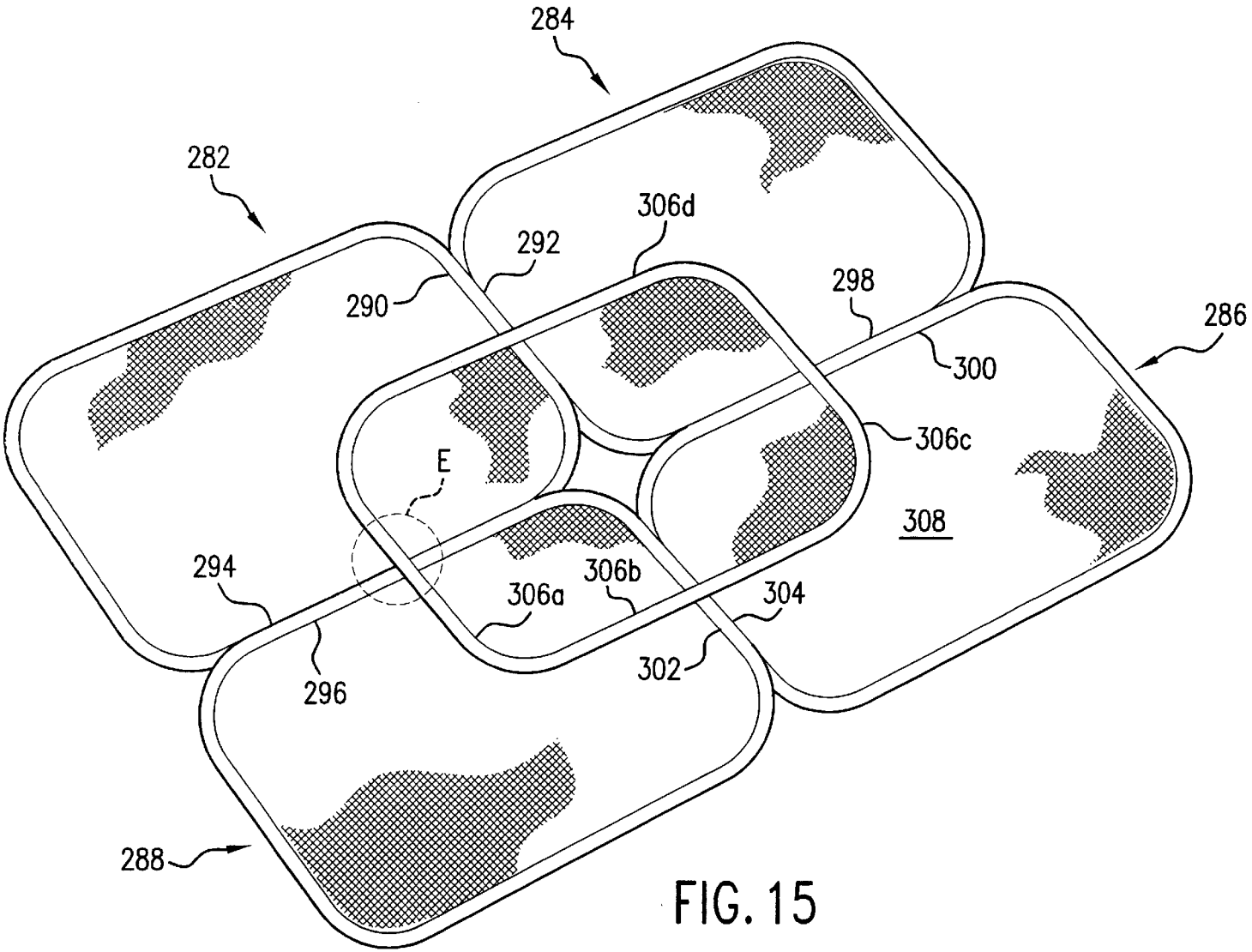
FIG. 15 is a perspective view of a collapsible panel according to yet another embodiment of the present invention.
Figure 16:
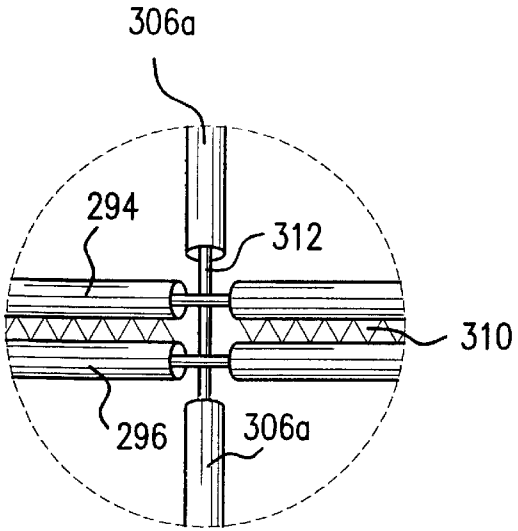
FIG. 16 is a partial cut-away view of the section E of the panel of FIG. 15.

FIGS. 15 and 16 extend the principles of FIG. 13 to larger panels. The structure 280 in FIGS. 15 and 16 has four separate panels 282, 284, 286 and 288, each having the same construction as the panel 20 except that each panel 282, 284, 286 and 288 only has the peripheral first frame member, and no second frame member. The left side 290 of the panel 282 is hingedly coupled (e.g., by stitching 310) to the right side 292 of the panel 284, the bottom side 294 of the panel 282 is hingedly coupled to the top side 296 of the panel 288, the bottom side 298 of the panel 284 is hingedly coupled to the top side 300 of the panel 286, and the left side 302 of the panel 288 is hingedly coupled to the right side 304 of the panel 286. A second sleeve 306 is provided (e.g., by stitching) on the fabric 308 of the four panels 282, 284, 286 and 288 in a manner in which the second sleeve 306 has a four-sided configuration, with a left side 306*a* extending across the panels 282 and 288, a bottom side 306*b* extending across the panels 288 and 286, a right side 306*c* extending across the panels 284 and 286, and a top side 306*d* extending across the panels 282 and 284. A second frame member 312 is housed inside the second sleeve 306, and extends throughout the second sleeve 306. At the locations where the second sleeve 306 crosses over the sleeves of the panels 282, 284, 286 and 288, the second frame member 312 overlaps or crosses over the frame members of the panels 282, 284, 286 and 288. For example, FIG. 16 illustrates one such crossing location for the sleeve section 306*a* crossing the bottom side 294 of panel 282 and the top side 296 of panel 288. Thus, the second frame member 312 provides increased rigidity and stability for the central portion defined by the four panels 282, 284, 286 and 288. One useful application for the structure 280 is use as a large screen or board. Each panel of the four panels 282, 284, 286 and 288 can be part of a larger screen or board, and the second frame member 312 provides increased rigidity and stability for the central portion of the screen or board.

Figure 17:
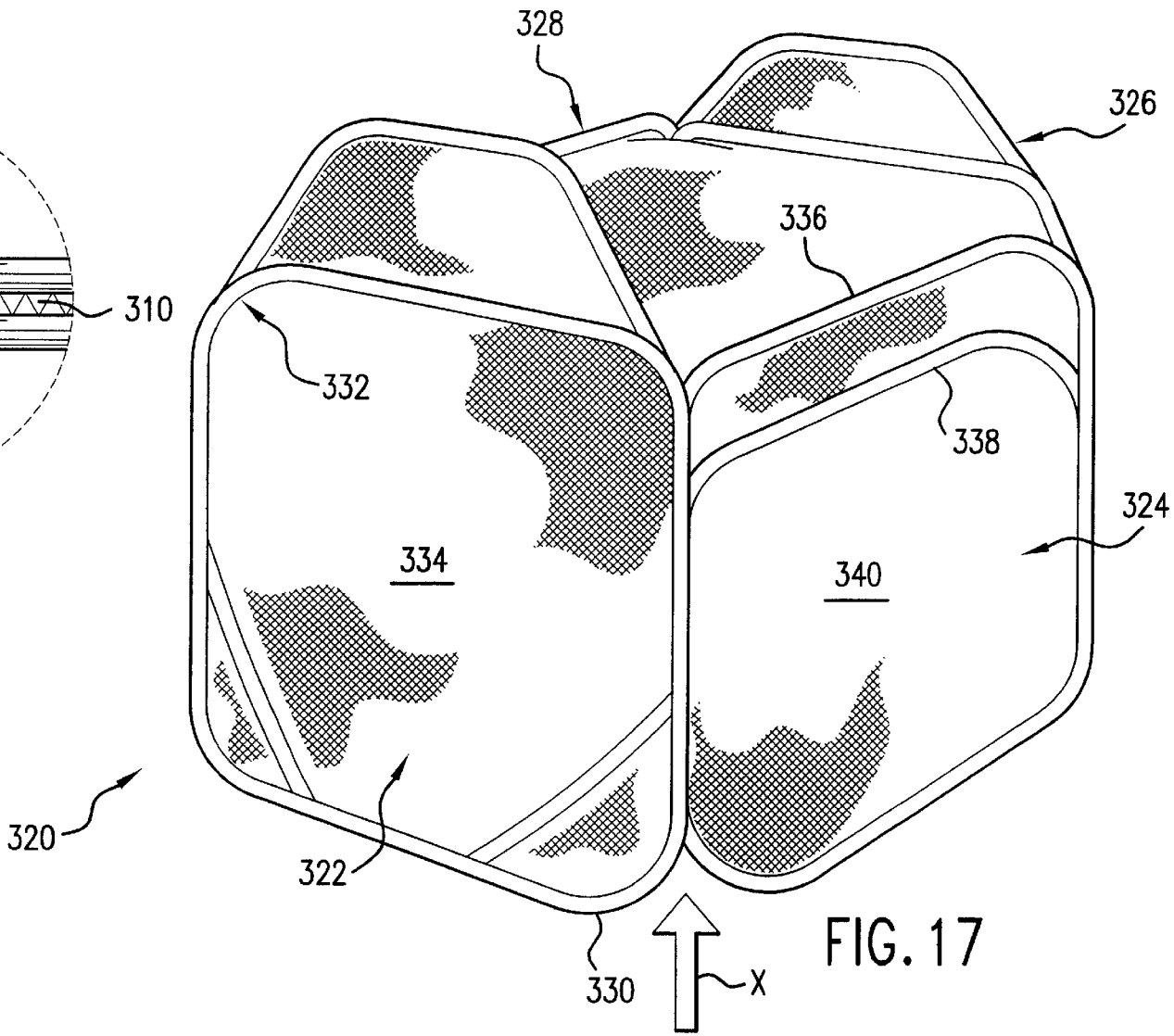
FIGS. 17, 18 and 19 are perspective views of collapsible structures according to different embodiments of the present invention.

FIG. 17 illustrates a collapsible structure 320 that can include one or more panels of the present invention. The structure 320 can include four panels 322, 324, 326 and 328, each having a left side that is hingedly coupled (e.g., by stitching or Velcro™ pads) to a right side of an adjacent panel to form a ring of panels 322, 324, 326 and 328. As shown in FIG. 17, the panel 322 can have a peripheral first frame member 330 and an internal second frame member 332 provided on the fabric material 334 of the panel 322. Similarly, the panel 324 can be similar to panel 50 of FIG. 3, with a peripheral first frame member 336 and an internal second frame member 338 provided on the fabric material 340 of the panel 324. The panels 322 and 324 can have different shapes and sizes, and their respective second frame members 332 and 338 can also be positioned at different locations and have different sizes, so as to provide selected rigidity and stability to selected locations within the panels 322 and 324. The structure 320 can be collapsed into a smaller configuration by first pushing in panels 322 and 324 (see arrow X) such that panel 322 rests against panel 328 and panel 324 rests against panel 326. Then, the two combined panels 322 and 328 are folded so as to be rested against the two combined panels 324 and 326 to form a stack of four panels 328, 322, 324, 326 (in that order). The stack of panels is then twisted and folded to collapse the frame members and panels into a smaller shape according to the steps illustrated in FIGS. 12A–12E.

Figure 18:
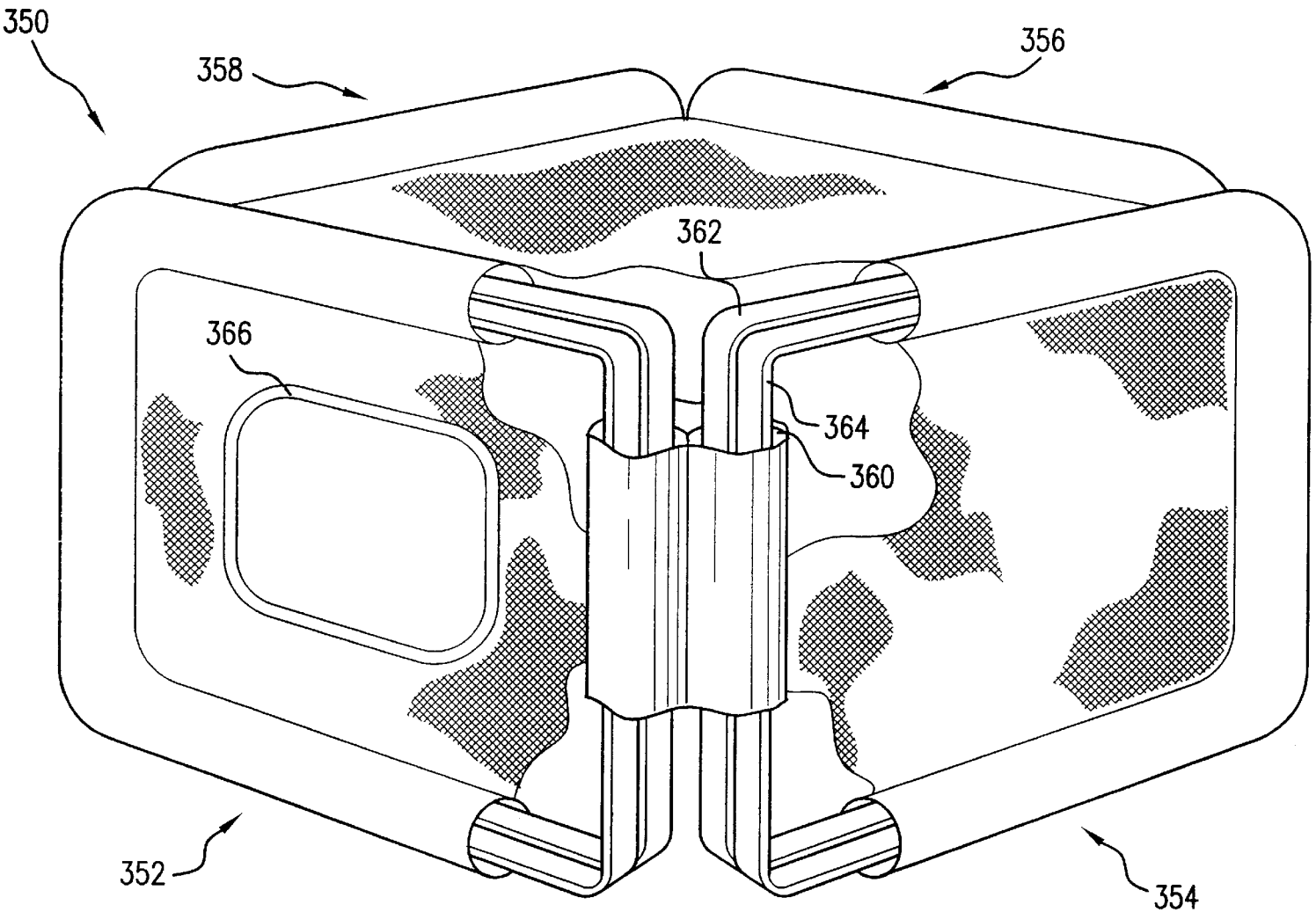

Even though the embodiments illustrated hereinabove provide a second frame member that is positioned within the confines or periphery of the first frame member, it is also possible to provide two or more frame members in the same frame retaining sleeve. For example, FIG. 18 illustrates a collapsible structure 350 that has four panels 352, 354, 356 and 358, each having a left side that is hingedly coupled (e.g., by stitching or Velcro™ pads) to a right side of an adjacent panel to form a ring of panels 352, 354, 356 and 358. Each panel 352, 354, 356 and 358 can have a peripheral frame retaining sleeve 360 that retains two frame members 362 and 364 in the same sleeve 360. By providing two peripheral frame members 362, 364, the border or periphery of the panel is strengthened and enjoys stronger stability. Each panel 352, 354, 356 and 358 can also be provided with a second sleeve 366 that retains another frame member to provide selected locations with increased rigidity and stability. The structure 350 can be folded and collapsed in the same manner as structure 280.

Figure 19:
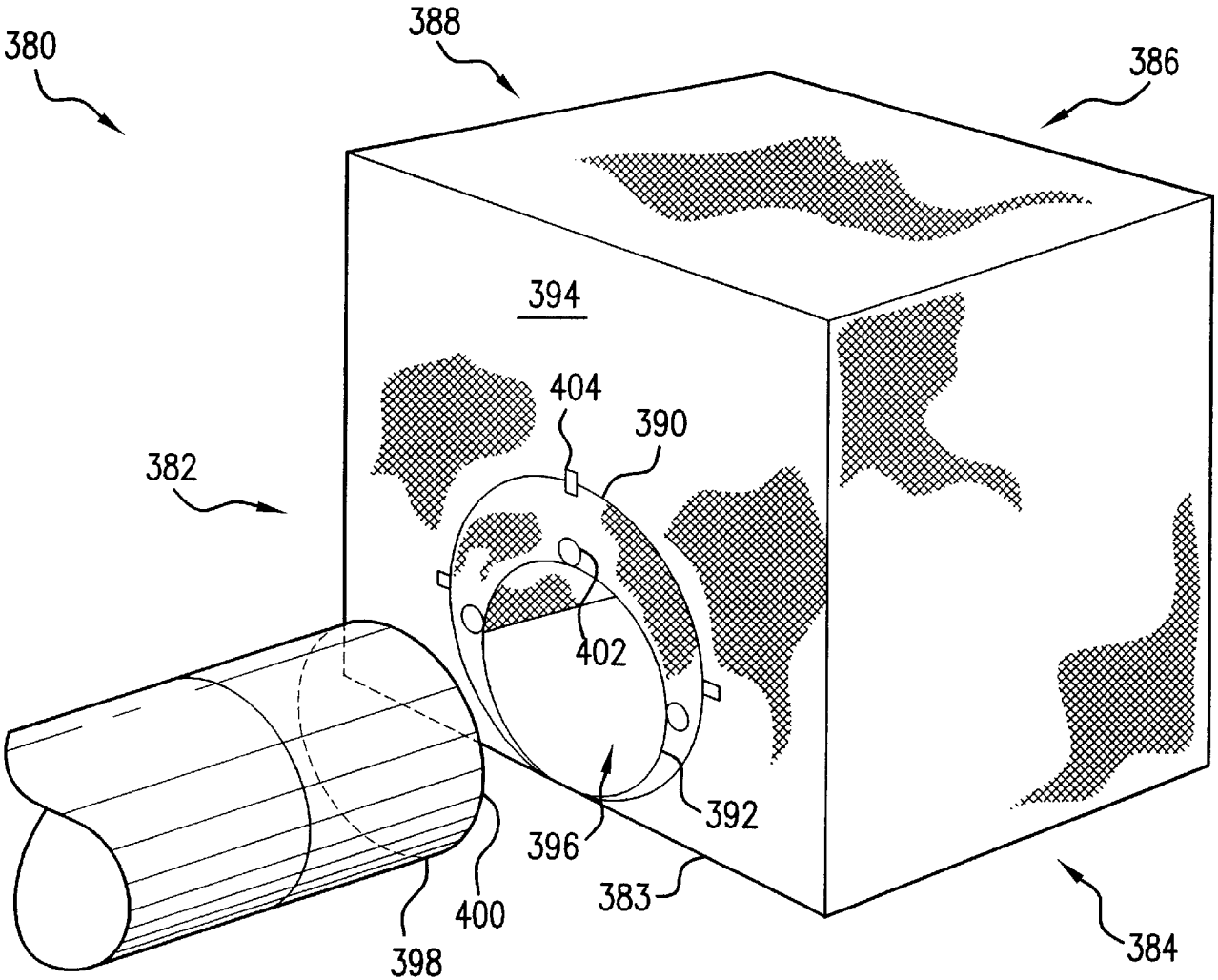

FIG. 19 illustrates another collapsible structure 380 that has four panels 382, 384, 386 and 388, each having a left side that is hingedly coupled (e.g., by stitching or Velcro™ pads) to a right side of an adjacent panel to form a ring of panels 382, 384, 386 and 388. One panel 382 has two concentric sleeves 390 and 392 that are stitched or otherwise provided on the fabric 394 of the panel 382. Each concentric sleeve 390 and 392 can be entirely separate from the frame member that defines the periphery of the panel 382. Alternatively, portions of each concentric sleeve 390 and 392 can extend along a small portion of the sleeve 383 that houses the frame member that defines the periphery of the panel 382. A separate frame member can be completely housed inside each sleeve 390 and 392. The smaller sleeve 392 actually defines an opening 396 that can be aligned with one open end 400 of a tunnel 398. Since the open end 400 is adapted to be coupled or connected (e.g., via loops 402, toggles, opposing Velcro™ pads, or the like) to the sleeve 392, it would be desirable to strengthen the region around the sleeve 392. Therefore, the larger concentric sleeve 390 and its frame member are provided adjacent the sleeve 392 to provide increased rigidity and stability to the connection of the sleeve 392 and the open end 400. As an alternative function, the larger concentric sleeve 390 and its frame member allows another tunnel (similar to tunnel 398) having a greater diameter to be coupled thereto, such as via the loops 404. As yet a further alternative, the sleeve 392 does not need to have a frame member housed therein and can be provided as a border.

Thus, the present invention provides panels having one or more frame members that are configured and positioned at a variety of different locations to provide panels having better stability and rigidity at selected locations. As a result, stronger and more useful panels can be provided for use in a wider range of applications, thereby increasing the utility and value of collapsible panels.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible panel comprising:

a first foldable frame member having a folded and an unfolded orientation, with a fabric material covering selected portions of the first frame member;

a second foldable frame member having a folded and an unfolded orientation, with the fabric material covering selected portions of the second frame member; and a sleeve that retains portions of the first and second frame members, wherein the sleeve extends along portions of at least two separate sides of the first frame member and the second frame member.

2. The panel of claim 1, wherein the first frame member is oriented in a first plane, and wherein an angled portion of the second frame member is oriented in a second plane that is angled with respect to the first plane.

3. The panel of claim 2, wherein the sleeve is a first sleeve, and further including a second sleeve that retains the angled portion of the second frame member.

* * * * *